US012357064B2

(12) United States Patent
Quarrles

(10) Patent No.: US 12,357,064 B2
(45) Date of Patent: Jul. 15, 2025

(54) JEWELRY FABRIC

(71) Applicant: Monique Quarrles, Hingham, MA (US)

(72) Inventor: Monique Quarrles, Hingham, MA (US)

(73) Assignee: Monique Quarrles, Hingham, MA (US)

( * ) Notice: Subject to any disclaimer, the term of this patent is extended or adjusted under 35 U.S.C. 154(b) by 0 days.

(21) Appl. No.: 17/870,518

(22) Filed: Jul. 21, 2022

(65) Prior Publication Data

US 2023/0023643 A1 Jan. 26, 2023

Related U.S. Application Data

(60) Provisional application No. 63/225,384, filed on Jul. 23, 2021.

(51) Int. Cl.

| | |
|---|---|
| ***A41D 27/08*** | (2006.01) |
| ***A44C 15/00*** | (2006.01) |
| ***A44C 25/00*** | (2006.01) |

(52) U.S. Cl.

CPC ..... *A44C 25/008* (2013.01); *A41D 27/08* (2013.01); *A44C 15/001* (2013.01)

(58) Field of Classification Search

CPC ..... A47D 27/08; A44C 5/007; A44C 15/00; A44C 15/001; A41D 27/08

See application file for complete search history.

(56) References Cited

U.S. PATENT DOCUMENTS

| | | | | |
|---|---|---|---|---|
| 5,953,757 | A * | 9/1999 | Blanks, I | G09F 21/02 2/243.1 |
| 6,175,963 | B1 * | 1/2001 | Loeffelholz | A43B 23/24 2/200.1 |
| 2005/0060784 | A1 * | 3/2005 | Emeth | G09F 21/02 2/93 |
| 2013/0145522 | A1 * | 6/2013 | da Silva | A41D 27/08 2/244 |
| 2019/0116899 | A1 | 4/2019 | Williams et al. | |

FOREIGN PATENT DOCUMENTS

| | | |
|---|---|---|
| CN | 207721254 U | 8/2018 |
| CN | 209788532 U | 12/2019 |
| CN | 212382109 U | 1/2021 |

* cited by examiner

*Primary Examiner* — Sally Haden
(74) *Attorney, Agent, or Firm* — Foley & Lardner LLP

(57) ABSTRACT

A jewelry article for a garment of clothing includes a backing layer having a first side and a second side, a jewelry layer coupled to the first side of the backing layer, a first fastening member, and a second fastening member. The first fastening member is coupled to at least one of the jewelry layer or the backing layer and extends along the backing layer. The first fastening member is configured to detachably couple the backing layer to a corresponding fastener coupled to a garment of clothing. The second fastening member is coupled to at least one of the backing layer or the jewelry layer and is configured to detachably couple opposing portions of the backing layer.

15 Claims, 9 Drawing Sheets

JEWELRY FABRIC

CROSS-REFERENCE TO RELATED APPLICATIONS

This application claims priority to, and the benefit of, U.S. Provisional Patent Application Ser. No. 63/225,384, filed Jul. 23, 2021, which is incorporated herein by reference in its entirety.

BACKGROUND

A jewelry article consists of decorative items worn for personal adornment. Jewelry articles may be made from a variety of different materials including, but not limited to, gemstones, precious metals, beads, metal pieces, and shells, which may be interconnected and placed onto a user's body to provide an appealing aesthetic. Jewelry articles may be specifically tailored for use in a single area of the body such as necklaces, earrings, and bracelets, or may be permanently attached to articles of clothing to form part of the clothing.

SUMMARY

One embodiment of the present disclosure relates to a jewelry article that includes a backing layer having a first side and a second side, a jewelry layer coupled to the first side of the backing layer, a first fastening member, and a second fastening member. The first fastening member is coupled to at least one of the jewelry layer or the backing layer and extends along the backing layer. The first fastening member is configured to detachably couple the backing layer to a corresponding fastener coupled to a garment of clothing. The second fastening member is coupled to at least one of the backing layer or the jewelry layer and is configured to detachably couple opposing portions of the backing layer.

Another embodiment of the present disclosure relates to a garment that includes a wearable body defining a hollow portion, a fastener coupled to the wearable body, and a jewelry article. The jewelry article includes a backing layer having a first side and a second side, a jewelry layer coupled to the first side of the backing layer, and a first fastening member. The first fastening member extends along the backing layer and is coupled to (i) at least one of the jewelry layer or the backing layer and (ii) the fastener.

Yet another embodiment of the present disclosure relates to a method of making a jewelry article. The method includes coupling a jewelry layer to a first side of a backing layer and coupling a plurality of zippers to at least one of the jewelry layer or the backing layer so that each zipper of the plurality of zippers extends along a respective edge of the backing layer, the plurality of zippers together configured to detachably couple the jewelry layer and the backing layer to corresponding zippers on a garment. The method further includes coupling a second fastening member that is configured to detachably couple opposing portions of the backing layer to at least one of the backing layer or the jewelry layer.

BRIEF DESCRIPTION OF THE FIGURES

A more complete understanding of the method and apparatus of the present invention may be obtained by reference to the following Detailed Description when taken in conjunction with the accompanying figures wherein.

DETAILED DESCRIPTION

Before turning to the figures, which illustrate certain illustrative embodiments in detail, it should be understood that the present disclosure is not limited to the details or methodology set forth in the description or illustrated in the figures. It should also be understood that the terminology used herein is for the purpose of description only and should not be regarded as limiting.

Referring to the figures generally, a wearable jewelry (e.g., jewelry article, jewelry fabric, etc.) is shown that converts to a clothing embellishment. The jewelry may be provided with or as part of a garment of clothing or may be provided and used as a standalone piece of jewelry applied directly to the body.

Figure 1:
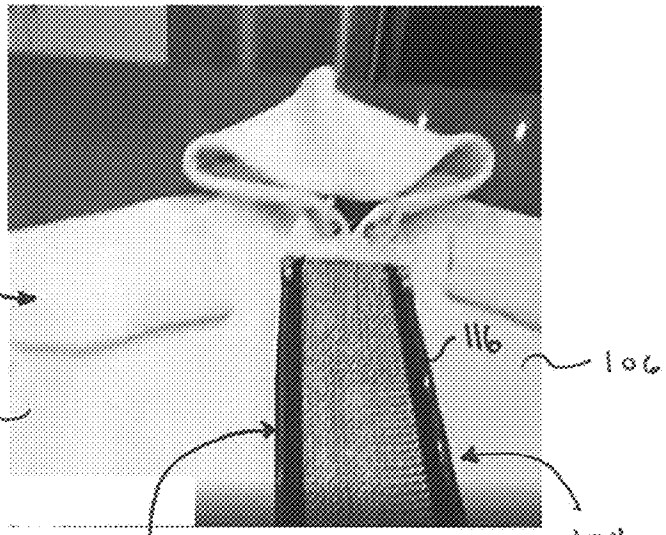
FIG. 1 is an isometric view of an illustrative garment that includes a removable jewelry article.

Referring to FIG. 1, a garment 100 is shown that includes a jewelry article that is removable from the garment. The garment 100 includes a wearable body 102 and a jewelry article 104 that is detachably coupled to the wearable body 102. The wearable body 102 or garment of clothing may include a shirt, sweater, pullover, pants, shoes, hats, jacket, scarf, gloves, or another type of wearable clothing. The wearable body 102 may define a hollow portion and/or including a sleeve, hem, hood, and/or collar. In other embodiments, the jewelry article 104 can be a (customized) handbag strap, incorporated into car seats, couches, pillow, or any other article with fabric.

The wearable body 102 may include at least one fabric made from a textile 106 such as cotton, silk, wool, nylon, polyester, another type of filament or fiber, and/or a combination thereof. In at least one embodiment, the wearable body 102 (see FIG. 3) includes a first fabric 108 woven to form a hollow portion 110 (e.g., a hollow interior, an internal cavity, etc.) that is configured to receive a user's body or a portion thereof (e.g., arms, legs, neck, shoulders, etc.).

Figure 3:
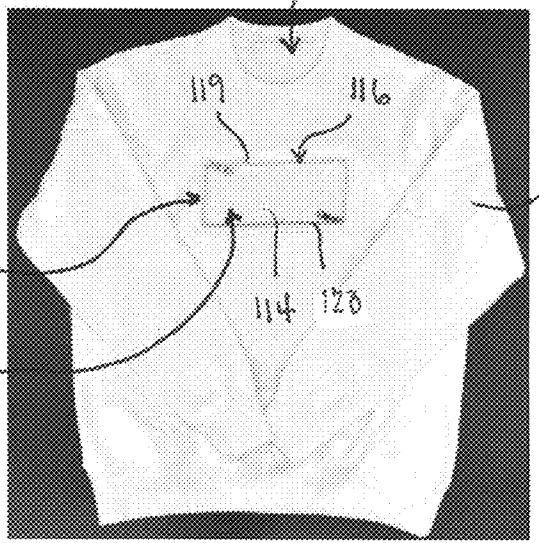
FIG. 3 is a top view of the garment of FIG. 2 with the jewelry article removed from the garment.

As shown in FIG. 1 and FIG. 3, the first fabric 108 defines an opening 112 configured to receive the jewelry article 104 therein. The jewelry article 104 is disposed substantially within the opening 112 and substantially covers the opening 112. The wearable body 102 may also include a second fabric 114 coupled (e.g., stitched, sewn, woven, etc.) to an underside of the first fabric 108 (e.g., a side of the first fabric 108 that faces the hollow portion 110. The second fabric 114 may extend across the opening 112 and may separate the opening 112 from the hollow portion 110. The opening 112 may form a recessed area 113 (e.g., depression, etc.) in the wearable body 102. The jewelry article 104 may be disposed within the opening 112 and substantially cover the opening 112 when secured to the wearable body 102. A portion of the jewelry article 104 may be recessed within the opening, between an outward facing surface of the first fabric 108 and an outward facing surface of the second fabric 114. For example, at least one of a backing layer, a second fastening member, and/or a cord of the jewelry article 104 may be recessed within the opening 112. It should be appreciated that a depth of the recessed area 113, and an amount of the jewelry article 104 that is recessed below the outward facing surface of the first fabric 108, may vary depending on a thickness of the first fabric 108.

Figure 2:
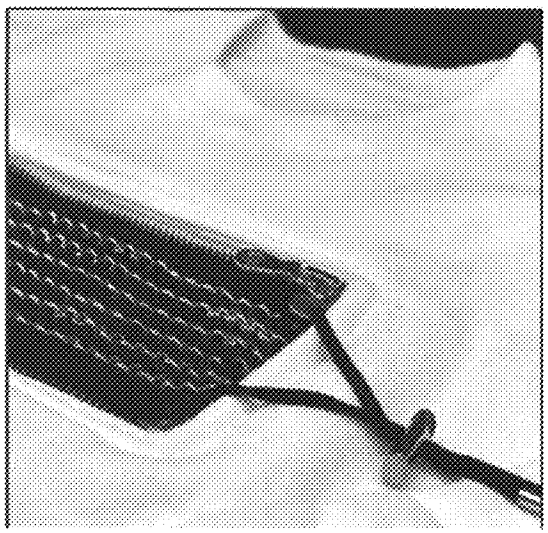
FIG. 2 is an isometric view of another illustrative garment that includes a removable jewelry article.

The jewelry article 104 may be coupled to the wearable body 102 at any desired location along the wearable body 102. For example, the jewelry article 104 may extend across a chest area of a sweater or shirt such as in a vertical orientation (e.g., longitudinally between a lower hem and hoodie of a sweater as shown in FIG. 1), a horizontal orientation (e.g., laterally between sleeves of a sweater as shown in FIG. 2 and FIG. 3), and/or any other desired orientation. In another embodiment, the jewelry article 104 may be coupled to a sleeve, hoodie, or any other suitable location along the wearable body 102. In yet other embodiments, the jewelry may form at least part of a manufacture's and/or designer's logo for the garment.

The jewelry article 104 may be detachably coupled to the wearable body, so that the jewelry article 104 is removable from the wearable body 102 without cutting, breaking, or otherwise damaging the wearable body 102 or jewelry article 104. For example, the jewelry article 104 may be coupled to the wearable body 102 via at least one fastening member, shown as fastener 116, such as zippers extending along opposing sides of the jewelry article 104.

The wearable body 102 may include a corresponding fastener(s) that couple with the fastening member(s) of the jewelry article 104. The fastener 116 may include zippers, magnets, clips, catches, etc. Non-parallel zippers (e.g., v-shaped) may alternatively be utilized. For example, the fastener 116 may include zippers oriented parallel to one another and spaced a distance apart to accommodate a width or height of the jewelry article 104. The fastener 116 may be oriented vertically, horizontally, around a cuff, and/or any desired position along the wearable body 102. The jewelry article 104 may be interchanged with others having different designs (numbers and/or arrangement of ornaments, etc.). The jewelry article may be made in a variety of sizes and shapes, and corresponding sizes and shapes of the fastener may be disposed on the wearable body.

For example, and referring to FIG. 3, the fastener 116 may include a body first zipper 119 and a body second zipper 120 spaced apart from the body first zipper 119 and oriented substantially parallel to the body second zipper 120. Note that similar numbering in FIG. 1 and FIG. 3 have been used to identify similar components). The zippers may be disposed along opposing outer edges of the opening 112 and may extend along an entire length of the outer edges to secure the jewelry article 104 within the opening 112 and to reduce any unsecured length of the jewelry article 104. The zippers may be secured (e.g., stitched, sewn, woven, etc.) to the first fabric 108 and/or the second fabric 114, and may be disposed at least partially between the first fabric 108 and the second fabric 114 so that the fastener is at least partially recessed within the opening 112. In other embodiments, another type of fastener may be used to couple the jewelry article 104 to the wearable body 102 including magnet(s), clips, snaps, buckles, loops and hooks, etc.

The jewelry article 104 may be removed from the wearable body 102 and may be worn separately from the wearable body 102. Stated differently, in a first mode of operation, the jewelry article 104 is connected to the wearable body 102. In a second mode of operation, the jewelry article 104 may be used as wearable jewelry separate from the wearable body 102 (e.g., as a necklace, bracelet, anklet, head pieces, rings, etc.).

Figure 4:
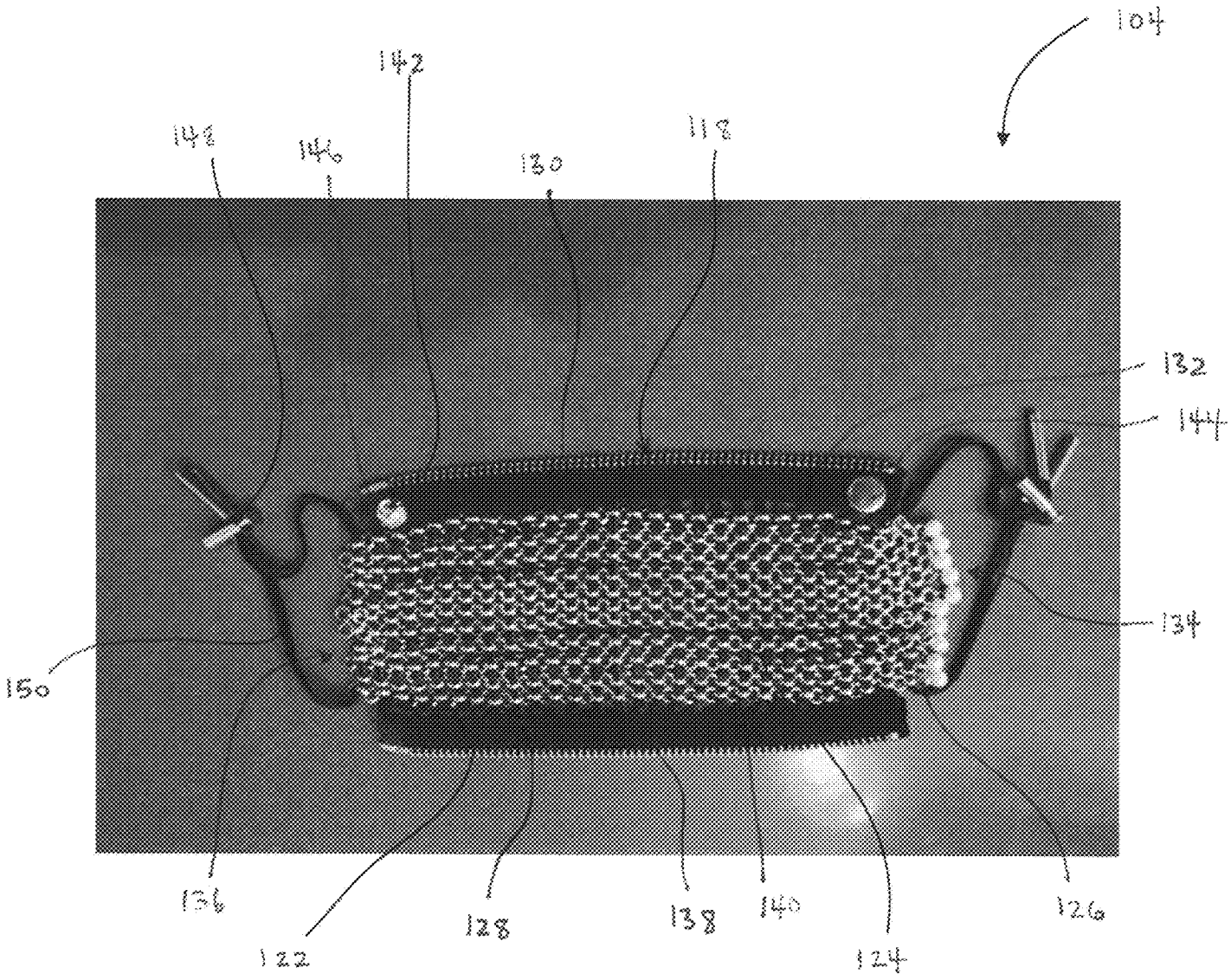
FIG. 4 is a top view of jewelry article from the garment of FIG. 1.
Figure 6:
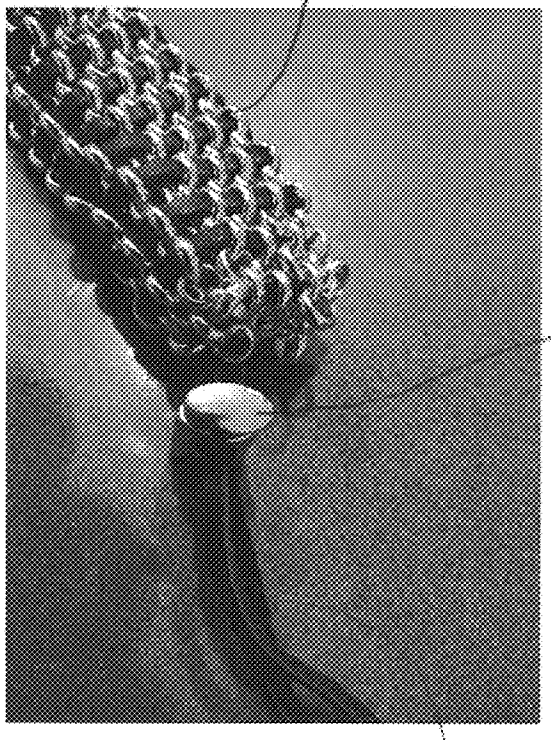
FIG. 6 is an isometric view of an end portion of the folded jewelry article of FIG. 5.

Referring to FIG. 4, a jewelry article 104 that has been disconnected from a wearable body is shown. The jewelry article 104 includes a backing layer 122 (e.g., fabric, leather, etc.) and a jewelry layer 124 (e.g., an ornament layer, a decorative layer, etc.) coupled to the backing layer 122.

The backing layer 122 may extend across the entire jewelry article 104 or only a portion thereof. The backing layer 122 may form a soft skin-facing layer of the jewelry article 104 to improve user comfort when worn and to prevent contact between the ornament(s) and a person's skin. The backing layer 122 may include a stretchable or non-stretchable material that can be wrapped or otherwise formed around a person's leg, arm, neck, ankle, etc. for wearing the jewelry article separately from the wearable body. The backing layer 122 may be made from at least one of a fabric (e.g., made from silk, cotton, nylon, or any other suitable textile) or a leather textile.

The jewelry layer 124 may be interwoven (e.g., stitched, sewn, interlaced, etc.) with the backing layer 122. The jewelry layer 124 may include ornaments 126, such as beads, gems, pendants, charms, and the like.

The ornaments 126 may be detachably coupled to the jewelry article 104 (e.g., backing layer 122) using zippers, buttons, snaps, or the like. In other embodiments, the ornaments 126 or jewelry layer 124 may be woven (e.g., stitched, sewn, interlaced, etc.) into the backing layer 122, glued, or otherwise bonded or fastened to the backing layer 122 and may extend across a first side 128 of the backing layer 122.

The first fastening member 118 is configured to detachably couple the backing layer 122 and/or jewelry layer 124 to the fastener(s) on the wearable body, and may be woven or otherwise bonded, fastened, or integrally formed with the backing layer 122 and/or jewelry layer 124. The first fastening member 118 may extend along the backing layer 122. The first fastening member 118 may include an article first zipper 130 extending along a first edge 132 (e.g., an upper edge, etc.) of the backing layer 122 between a first end 134 of the backing layer 122 and a second end 136 of the backing layer 122. The first fastening member 118 may further include an article second zipper 138 extending along a second edge 140 (e.g., a lower edge, etc.) of the backing layer 122 between the first end 134 and the second end 136. In some embodiments, the first edge 132 and the second edge 140 may be disposed on opposite sides of the backing layer 122 and/or jewelry layer 124. The article first zipper 130 and/or the article second zipper 138 may extend along an entire length of the backing layer 122 and/or jewelry layer 124.

The zippers may be secured (e.g., stitched, sewn, woven, etc.) to the backing layer 122 and/or the jewelry layer 124. In other embodiments, another type of fastening member may be used to couple the jewelry article 104 to the wearable body including magnet(s), clips, snaps, buckles, loops and hooks, etc.

Figure 18:
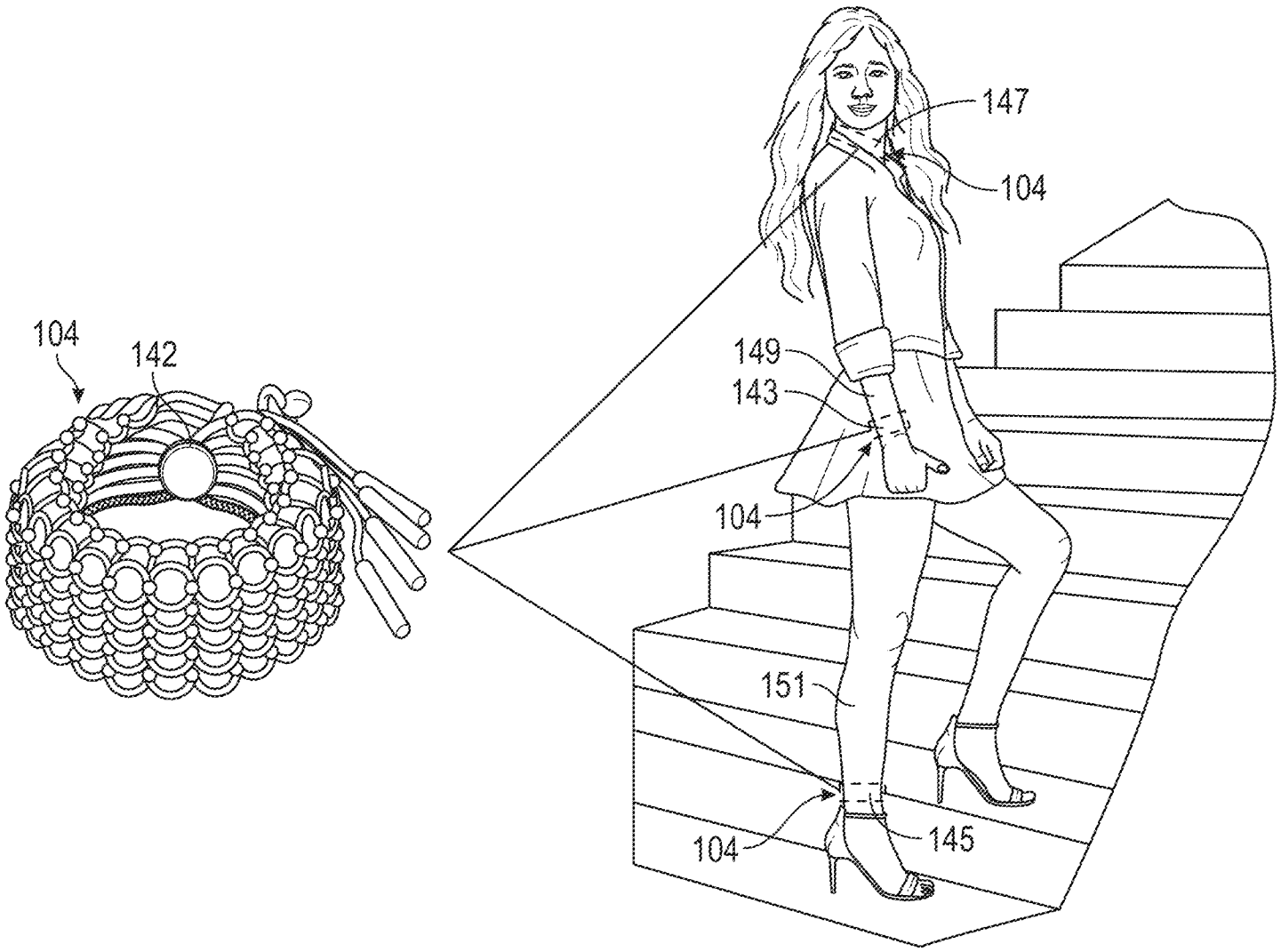
FIG. 18 is reproduction of a portion of FIG. 9 inclusive of the folded jewelry article of FIG. 9 and showing an isometric view of locations at which the folded jewelry article may be placed on a person inclusive of the person's ankle, wrist, and neck.

Referring to FIG. 18, the jewelry article 104 may also include a second fastening member 142 configured to couple the jewelry article 104 (e.g., the backing layer 122, the jewelry layer 124, etc.) to an individual's wrist 143, ankle 145, neck 147, arm 149, leg 151, etc. The second fastening member 142 may be a button connector, magnet, or another type of fastener, and may be disposed on opposing sides of the jewelry article 104 (e.g., the backing layer 122, the jewelry layer 124, etc.) as the first fastening member 118. For example, the second fastening member 142 may include a button connector having a socket 144 coupled to the backing layer 122, the jewelry layer 124, and/or the first fastening member 118 proximate to the first end 134 of the backing layer 122, and a stud 146 coupled to the backing layer 122, the jewelry layer 124, and/or the first fastening member 118 proximate to the second end 136 of the backing layer 122. In other embodiments, the second fastening member 142 may be disposed on the same sides of the jewelry article 104 as the first fastening member 118. In some embodiments, the first fastening member 118 and the second fastening member 142 may be the same (a zipper used to connect the jewelry article 104 to the wearable body may also be used to secure the jewelry article 104 to a person's wrist, ankle, neck, etc.). For example, the article first zipper 130 may be zippered to the article second zipper 138, which are both connected to the jewelry article 104.

FIGS. 5-11 shows the jewelry article 104 reconfigured for use as wearable jewelry separate from a wearable body. The jewelry article 104 may roll or fold back onto itself to conceal the first fastening member 118 when used as wearable jewelry independent from the wearable body. The jewelry article 104 may include a cinching member 148 that secures the jewelry article in a rolled or folded position. In another embodiment, the first fastening member 118 may not be concealed in the folded position.

The cinching member 148 may include a strap or cord 150 on either end of the jewelry article 104. The cord 150 may be coupled (e.g., stitched, sewn, interwoven, etc.) to the backing layer 122 and/or the jewelry layer 124 and may extend along the first end 134 of the backing layer 122. In some embodiments, the cinching member 148 includes a second cord disposed on the second end of the backing layer 122 opposite from the cord 150. In some embodiments, the cord 150 extends through the jewelry article (e.g., the jewelry layer 124, etc.).

Figure 5:
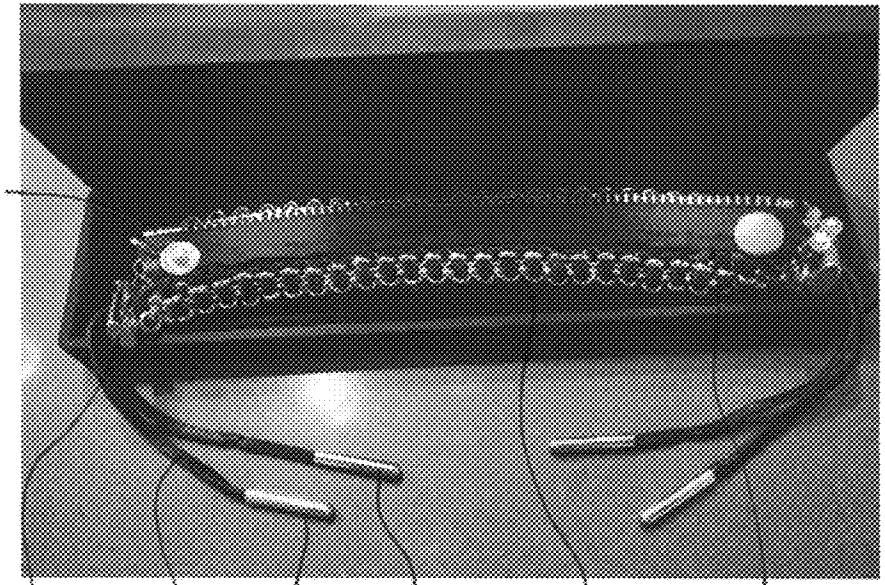
FIG. 5 is an isometric view of the jewelry article of FIG. 4 in a folded position.

In at least one embodiment, the cord 150 also includes a cord lock 152 that is engaged with the cord 150 in two locations between a first free end 154 of the cord 150 and a second free end 156 of the cord 150. As shown in FIG. 4 and FIG. 5, when separated from the wearable body, the jewelry article 104 may be reconfigurable between an unfolded position (FIG. 4)—in which the first fastening member 118 is accessible to the user—and a folded position (FIG. 5)—in which the first fastening member is concealed from view (e.g., beneath the jewelry layer 124, etc.). The cord lock 152 may be configured to cinch the strap or cord 150 near the jewelry layer 124 and/or backing layer 122 when the jewelry article 104 is folded onto itself (e.g., in half, in the folded position, etc.) to hold the jewelry article 104 in the second mode of operation so that the jewelry article 104 can be worn separate from the wearable body (so that the backing layer 122 and first fastening member 118 are hidden from view when the jewelry article 104 is worn separately from the wearable body).

Figure 8:
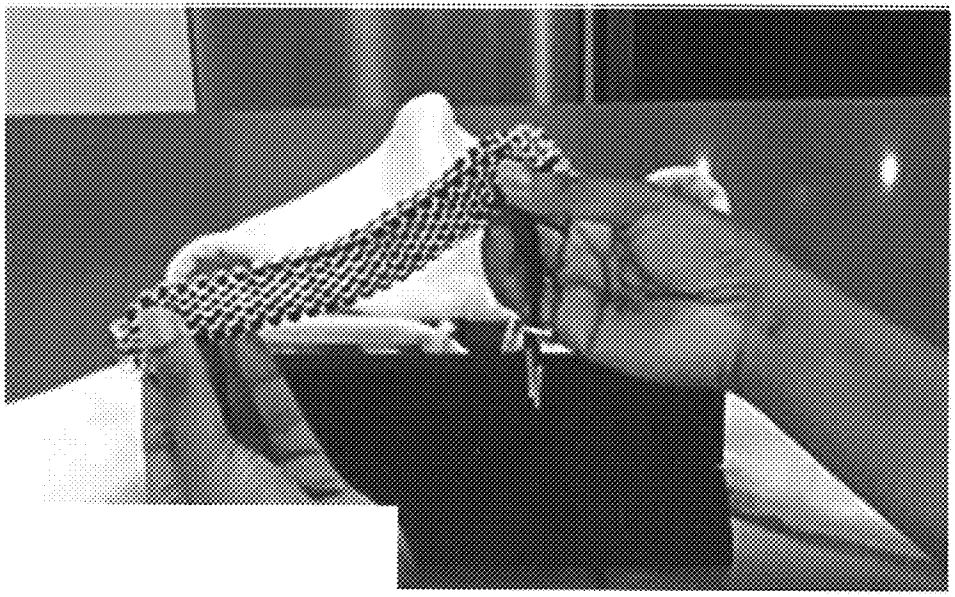
FIG. 8 is another isometric view of the folded jewelry article of FIG. 5.
Figure 7:
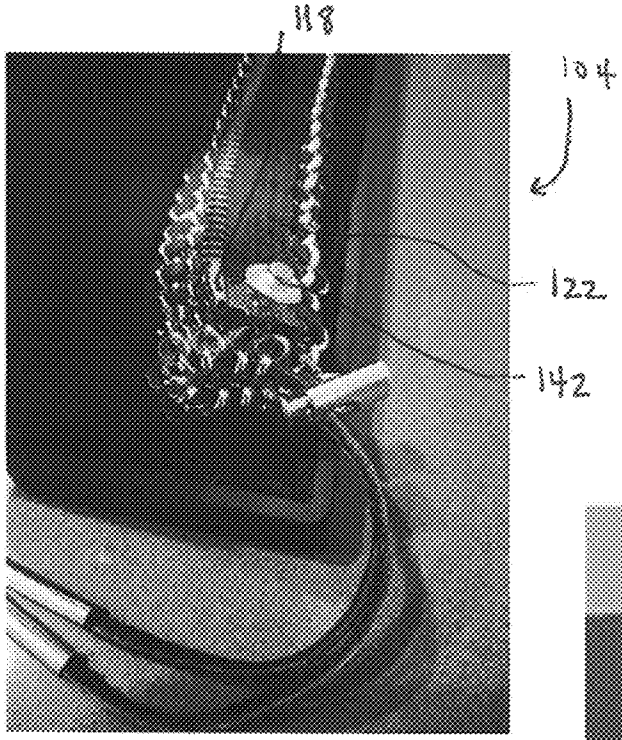
FIG. 7 is an isometric view of another end portion of the folded jewelry article of FIG. 5.
Figure 10:
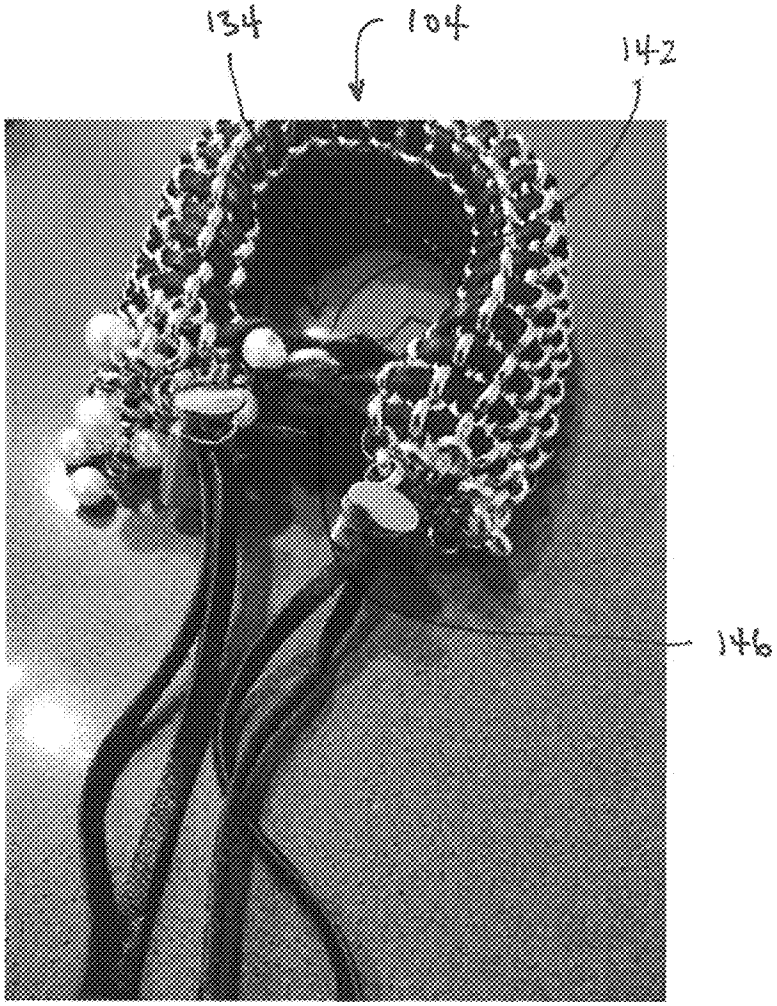
FIG. 10 is another isometric view of the folded jewelry article of FIG. 5 when configured as a bracelet.
Figure 9:
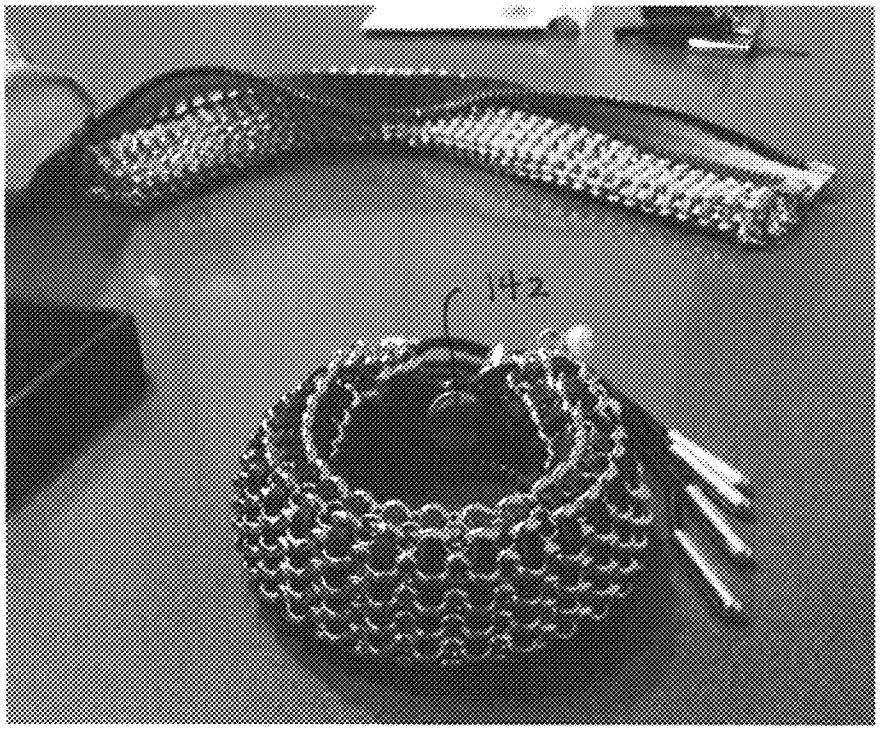
FIG. 9 is an isometric view of the folded jewelry article of FIG. 5 that is configured for use as a bracelet.
Figure 11:
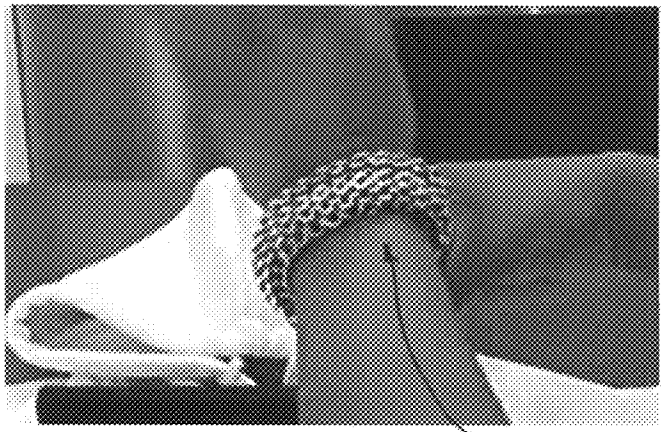
FIG. 11 is an isometric view of the folded jewelry article of FIG. 5 attached to a person's wrist.
Figure 12:
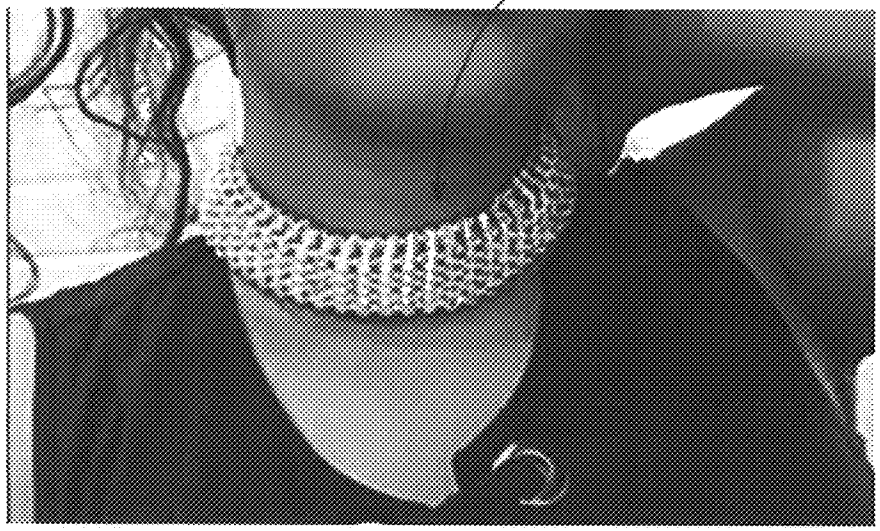
FIG. 12 is an isometric view of another illustrative jewelry article that is configured for use as a necklace.

The jewelry article 104 may be configured so that the backing layer 122, the first fastening member 118, and/or the second fastening member 142 are concealed from view in the second mode of operation (but with the second fastening member 142 accessible for use beneath the jewelry article 104 as shown in FIG. 8).

As shown in FIGS. 9-12, a person may secure the jewelry article 104 to their neck, arm, ankle, etc. via the second fastening member 142 (e.g., a button connector, etc.), by wrapping the jewelry article 104 (in the folded position) over an appendage and securing the second fastening member 142 to connect opposing ends (or regions towards opposing ends, the first end 134 and the second end 136, etc.) of the jewelry article 104. In some embodiments, the jewelry article 104 may also include a separate (e.g., a second) cinching member extending along a length of the jewelry article, between opposing sides of the jewelry article, that allow the wearer to adjust the jewelry article to the desired fit.

Figure 13:
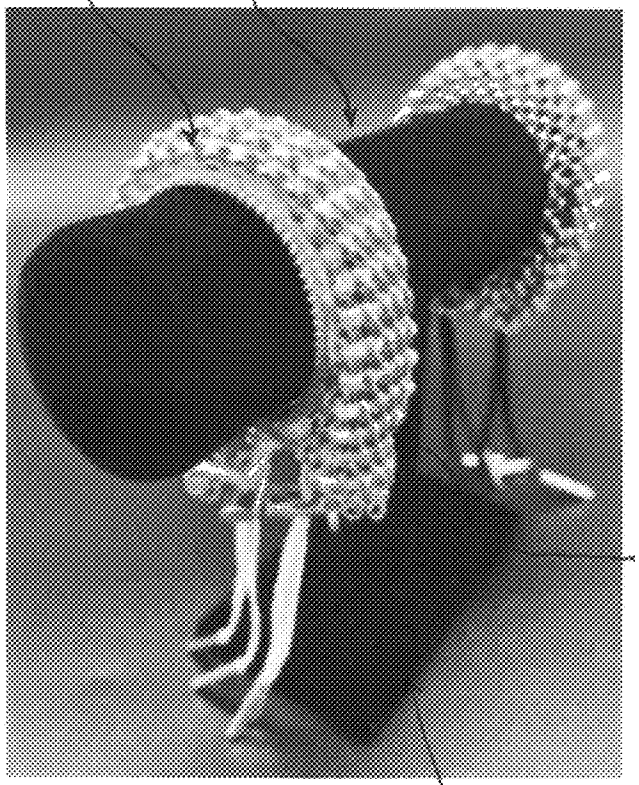
FIG. 13 is an isometric view of an illustrative display for a jewelry article.

Another aspect of the present disclosure is a display and/or storage container for a detachable jewelry article. Referring to FIG. 13, an illustrative display 200 for the jewelry article is shown. The display 200 includes a pedestal 202 and a support member 204 that is coupled to the pedestal 202. The support member 204 may be coupled to a vertical pedestal arm 206 of the pedestal 202 and is configured to support the jewelry article in a folded position. The support member 204 may be centered on the vertical pedestal arm 206 so that jewelry articles may be attached to either side of the support member 204. In at least one embodiment, the support member 204 is an elongated cylinder or rod that simulates the shape of a person's arm or neck. In other embodiments, the shape of the support member 204 may be different.

Figure 14:
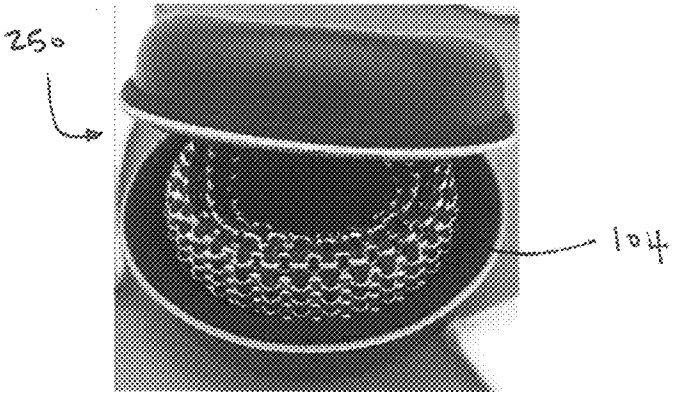
FIG. 14 is an isometric view of an illustrative storage container for a jewelry article.

FIG. 14 shows a storage device or container that may be used with the jewelry article of the present disclosure. The storage container 250 includes a cylindrically-shaped body defining a hollow cavity that is sized to receive the jewelry article therein. In some embodiments, the storage container 250 is shaped to match a shape of the jewelry article in the folded position. The storage container 250 may include upper and lower bodies and may include a fastener to detachably couple the bodies together to secure the jewelry article within the hollow cavity. For example, the storage container 250 may include a zipper that can be used to couple the upper and lower bodies together.

Figure 15:
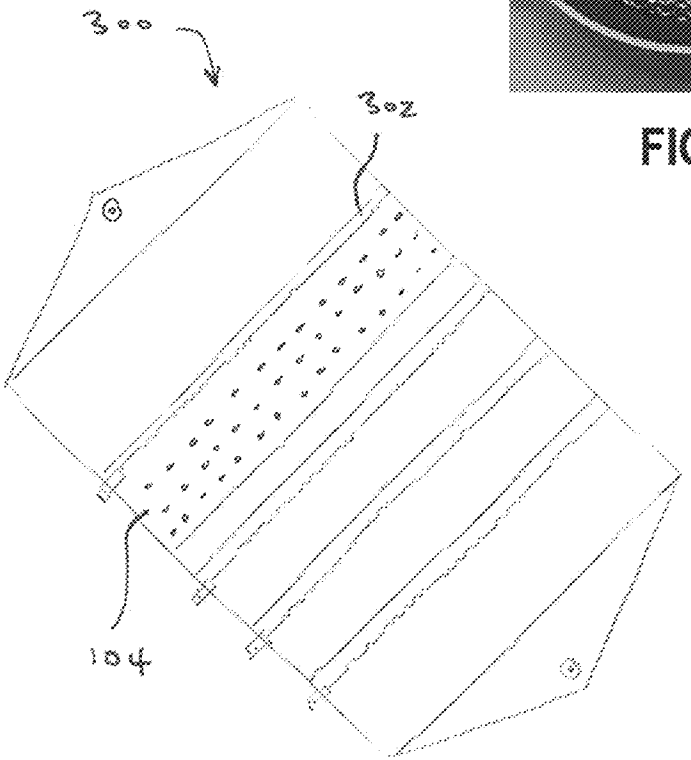
FIG. 15 is an isometric view of an illustrative storage cloth for a jewelry article.

FIG. 15 shows a storage and/or travel cloth 300 for multiple detachable jewelry articles. The travel cloth 300 can provide protection to the jewelry articles when not in use and facilitates selection between different jewelry articles by displaying all of the jewelry articles side-by-side when opened. The travel cloth 300 may include multiple zippers, clasps, and/or fasteners 302 that couple to the first fastening member of the jewelry article to facilitate transport and/or selection of the jewelry article. For example, the storage cloth may include a piece of fabric and a plurality of zippers that allow multiple jewelry articles 104 to be connected to the cloth 300. The cloth 300 may then be folded onto itself, and/or include separate fasteners to close the cloth and conceal and protect the jewelry articles 104 therein.

Figure 16:
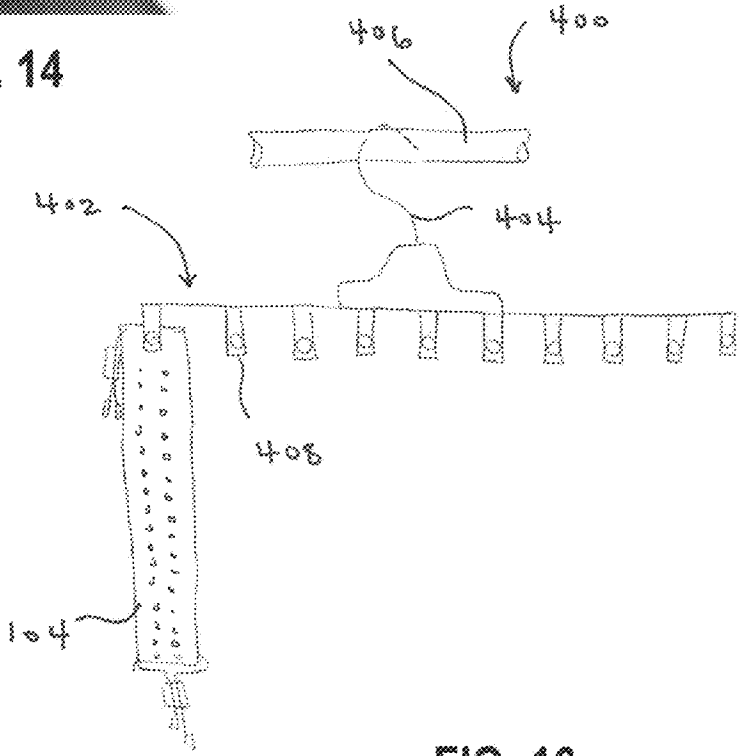
FIG. 16 is an isometric view of another illustrative display for a jewelry article.

FIG. 16 shows another illustrative embodiment of a display 400. The display 400 may be a retail display for selling jewelry articles of the present disclosure. The display 400 includes a support member 402 (e.g., rack, etc.) and a hanger 404 to connect the support member 402 to a display pole 406 (e.g., clothesline, clothes rack, etc.). The retail display 400 may also include multiple clasps 408 that support the jewelry articles 104 on the display 400. The clasps 408 may be configured to detachably couple to the first and/or second fastening member of the jewelry article 104. The clasps 408 may be structured to support a plurality of jewelry articles along their length and to allow the jewelry articles to at least partially move and/or dangle with respect to the support member 402 so that a person can easily compare multiple jewelry articles to one another. Other configurations of a hanger 404 or rack that may be supported by a permanent or non-permanent structure may be utilized to support one or more jewelry articles in a vertical or non-vertical orientation. For example, bins on which rolled-up jewelry articles, may be utilized. It should be understood that the jewelry articles may take a wide variety of shapes and sizes.

Figure 17:
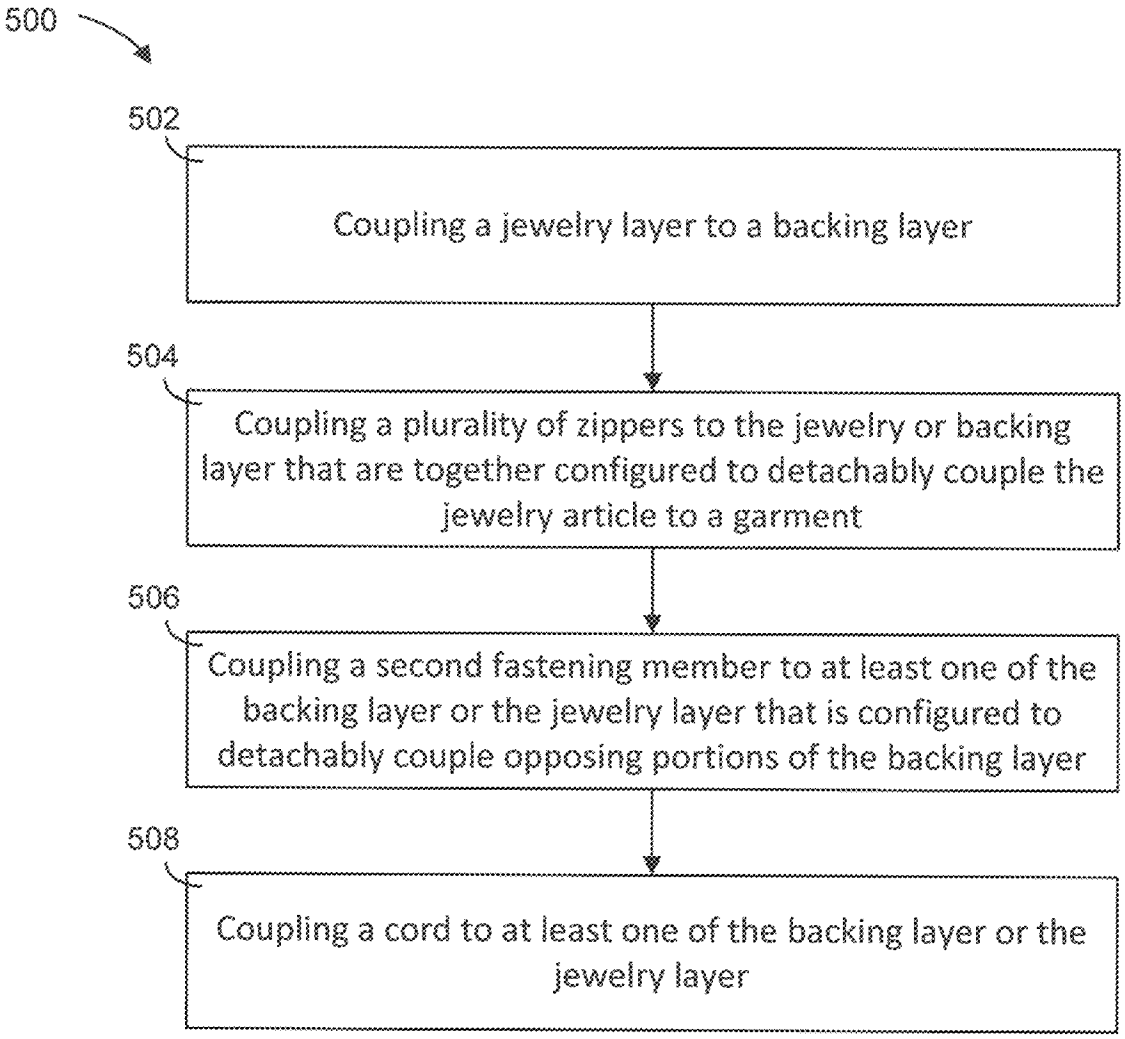
FIG. 17 is a flow diagram of a method of making a jewelry article.

FIG. 17 shows a method 500 of making or manufacturing a jewelry article, such as the jewelry article 104 of FIG. 4. The method 500 may include forming the jewelry article as described herein and forming a wearable body with corresponding fasteners to enable the jewelry article to be coupled to the wearable body or to be removable from the wearable body and used as standalone jewelry.

At 502, a jewelry layer is coupled to a backing layer. Operation 502 may include providing or forming a jewelry layer by weaving or otherwise connecting multiple beads, gems, shells, or other ornaments together. Operation 502 may include forming the backing layer by cutting a piece of fabric to a size that approximately matches a size of the jewelry layer, or that complements the jewelry layer depending on a desired area of use (that is appropriately sized to fit around a person's arm, neck, etc. and to shield the person from the jewelry layer during use). Operation 502 may further include sewing the jewelry layer onto the backing layer, or using a suitable adhesive product to join the jewelry layer to the backing layer.

At 504, a fastening member is coupled to the backing layer and/or the jewelry layer. Operation 504 may include sewing multiple zipper teeth pieces or sections onto the backing layer so that each section extends along a respective edge of the backing layer (e.g., opposing edges of the backing layer, etc.). The zipper teeth sections may be configured to detachably couple the jewelry article to a wearable body of a garment. Operation 504 may include sewing a first zipper teeth section to the backing layer along an entire length of a first edge of the backing layer and sewing a second zipper teeth section to the backing layer along an entire length of a second edge of the backing layer.

At 506, a second fastening member is coupled to the backing layer and/or the jewelry layer. Operation 506 may include attaching a first portion of a button connector, magnet, or another suitable fastening device to the backing layer proximate to the first end of the backing layer, and coupling a second portion of the button connector or other fastening device to the backing layer proximate to the second end of the backing layer. The first and second portions of the fastener may be coupled to the backing layer proximate an upper or lower edge of the backing layer so that the fastener remains accessible to a user when the jewelry article is in a folded position.

At 508, a cord is coupled to the backing layer and/or the jewelry layer. Operation 508 may include weaving the cord through the jewelry article along a first end of the backing layer and repeating this operation for a second cord disposed proximate to a second end of the backing layer. Operation 508 may include pulling the cord through the jewelry article or backing layer so that the cord extends across the first end. Operation 508 may further include engaging a cord lock with the cord in at least two locations between a first free end of the cord and a second free end of the cord to secure the cord to the jewelry and/or backing layer and to facilitate manipulation of the jewelry article between a folded and unfolded position.

As utilized herein, the term "substantially" and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

While the instant disclosure has been described above according to its preferred embodiments, it can be modified within the spirit and scope of this disclosure. This application is therefore intended to cover any variations, uses, or adaptations of the instant disclosure using the general principles disclosed herein. Further, the instant application is intended to cover such departures from the present disclosure as come within the known or customary practice in the art to which this disclosure pertains.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It is noted that any element disclosed in one embodiment may be incorporated or utilized with any other embodiment disclosed herein.

I claim:

1. A garment, comprising:

a wearable body defining a hollow portion;

a fastener coupled to the wearable body; and a jewelry article, comprising:

a backing layer having a first side and a second side;

a jewelry layer coupled to the first side of the backing layer;

a first fastening member extending along the backing layer, the first fastening member coupled to (i) at least one of the jewelry layer or the backing layer and (ii) the fastener, the jewelry article having a first configuration in which the first fastening member removably couples the jewelry layer to the wearable body; and a plurality of second fastening members coupled to at least one of the jewelry layer or the backing layer, the jewelry article having a second configuration in which the plurality of second fastening members are removably coupled to one another to support the jewelry article by a body part of a user independent of the wearable body or another wearable body.

2. The garment of claim 1, wherein the wearable body includes a textile including at least one of a sleeve, hem, hood, or collar.

3. The garment of claim 1, wherein the fastener includes a first zipper and a second zipper spaced apart from the first zipper, the first zipper oriented substantially parallel to the second zipper.

4. The garment of claim 1, wherein the wearable body includes a first fabric defining an opening, and wherein the jewelry article is disposed within the opening and substantially covers the opening.

5. The garment of claim 4, wherein a portion of the jewelry article is recessed within the opening.

6. The garment of claim 1, wherein the plurality of second fastening members are disposed between (i) the jewelry layer or the backing layer and (ii) the wearable body when the jewelry article is secured to the wearable body.

7. The garment of claim 1, wherein in the second configuration, the plurality of second fastening members secure the jewelry article to one of a user's wrist, ankle, neck, arm, or leg.

8. The garment of claim 1, wherein in the second configuration, the jewelry article is arranged in a folded position in which the first fastening member is concealed from view.

9. The garment of claim 8, wherein the backing layer is also concealed from view in the second configuration.

10. The garment of claim 1, further comprising:

a cord coupled to at least one of the backing layer or the jewelry layer, the cord extending along a first end of the backing layer, the cord having a first free end and a second free end; and a cord lock engaged with the cord in two locations between the first free end and the second free end.

11. The garment of claim 10, wherein the jewelry article is reconfigurable between a folded position and an unfolded position using the cord lock, and the plurality of second fastening members are accessible to the user when the jewelry article is in the folded position.

12. The garment of claim 1, wherein the plurality of second fastening members are a different type of fastener as the first fastening member.

13. The garment of claim 1, wherein the plurality of second fastening members comprises a button connector having a socket and a stud, the socket and the stud connected to one another in the second configuration.

14. The garment of claim 1, wherein the backing layer is interwoven with the jewelry layer.

15. The garment of claim 1, wherein the backing layer comprises at least one of a fabric or leather textile.

* * * * *